United States Patent [19]

Cookson

[11] Patent Number: 4,573,729

[45] Date of Patent: Mar. 4, 1986

[54] TRAYS

[76] Inventor: Leonard A. Cookson, The Continental Hotel, Jerbourg St. Martin's, Channel Islands

[21] Appl. No.: 546,027

[22] Filed: Oct. 18, 1983

[30] Foreign Application Priority Data

Oct. 19, 1982 [GB] United Kingdom ..... 8230523

[51] Int. Cl.[4] ..... B65D 71/00

[52] U.S. Cl. ..... 294/158; 294/161; 294/172

[58] Field of Search ..... 294/158, 161, 144, 172; 220/23.6, 23.8, 23.83, 23.86; 206/503, 504, 510

[56] References Cited

U.S. PATENT DOCUMENTS 623,468 4/1899 Forbes ..... 294/172

3,053,424 9/1962 Reinhard ..... 294/158

3,224,655 12/1965 Buchanon et al. ..... 294/158

FOREIGN PATENT DOCUMENTS 126888 5/1919 United Kingdom ..... 294/161

1048201 11/1966 United Kingdom ..... 294/161

*Primary Examiner*—James B. Marbert

*Attorney, Agent, or Firm*—Fleit, Jacobson, Cohn & Price

[57] ABSTRACT

A demountable tray assembly comprises a cruciform base (3) supporting a pair of upright spaced-apart pillars (4) connected at the top by a carrying handle. A stack of trays (2) are located on the base by the pillars which pass through the trays mid-way between their ends, endwise or sideways movement of the trays thus being prevented. Spacers may be provided to maintain the trays in vertically spaced-apart relationship.

4 Claims, 5 Drawing Figures

TRAYS

This invention relates to trays of the kind employed for carrying food and drinks to a table.

In accordance with the invention there is provided a demountable tray assembly comprising a plurality of superimposed trays each having an aperture of a shape other than circular substantially centrally disposed and a base provided with upstanding supporting means terminating in a carrying handle, the supporting means being so shaped that it passes through each tray aperture and prevents any substantial movement of the trays other than at right angles to their planes.

Optionally the assembly may include spacers having means to engage successive tray edges and maintain the trays in spaced apart relationship.

For a clearer understanding of the invention, a preferred embodiment will be described with reference to the accompanying drawings, wherein.

Figure 1:
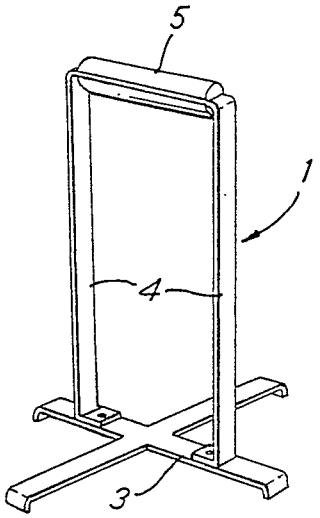
FIG. 1 shows a base member of a tray assembly according to the invention.
Figure 2:
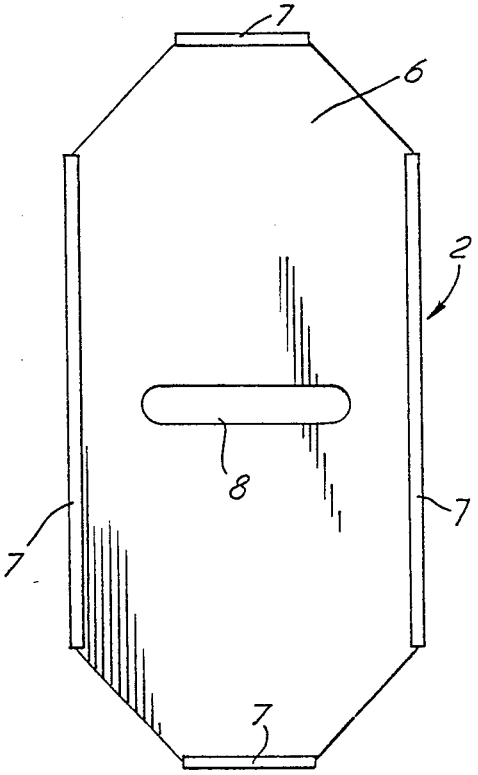
FIG. 2 shows a plan view of a tray to be carried by the base shown in FIG. 1.
Figure 3:
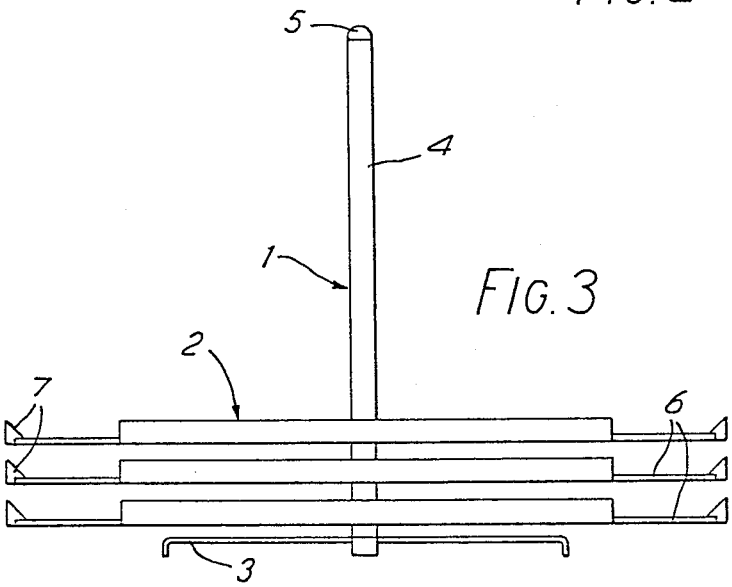
FIG. 3 shows an elevation of the base on which is mounted three trays.

In its simplest form shown in FIGS. 1–3 a tray assembly comprises a base 1 and a plurality of trays 2.

The base comprises a cruciform stand 3 carrying two spaced-apart supporting pillars 4 for a carrying handle 5. To reduce the space required for storage and packing for transit, the pillars may be releasably secured to the stand by screws passing through the stand into threaded holes in flanges at the bottom ends of the pillars. Each tray is of generally rectangular shape with chamfered corners and comprises a sheet 6 of wood, metal, or plastics material for example with triangular section edge strips 7 which assist in holding the tray and retaining dishes on the tray.

Centrally of the tray there is a transverse slit-like orifice 8 of a length slightly greater than the distance between the pillars. The trays are stacked on the base, the pillars and handle passing through the orifices. Due to non-circular shape of the orifice movement of each tray other than vertical is prevented by the interengagement of the orifices and pillars.

When such a tray assembly is employed in a restaurant, the dishes to be carried are often provided with covers. In consequence all the articles on any one tray can be of substantially the same height and a higher tray can be simply laid upon the tops of the articles on the tray beneath it without loss of stability and several trays may be carried at a time even when loaded. However, it unequally sized articles are to be carried, spacers are provided to retain the trays in spaced apart positions.

Figure 5:
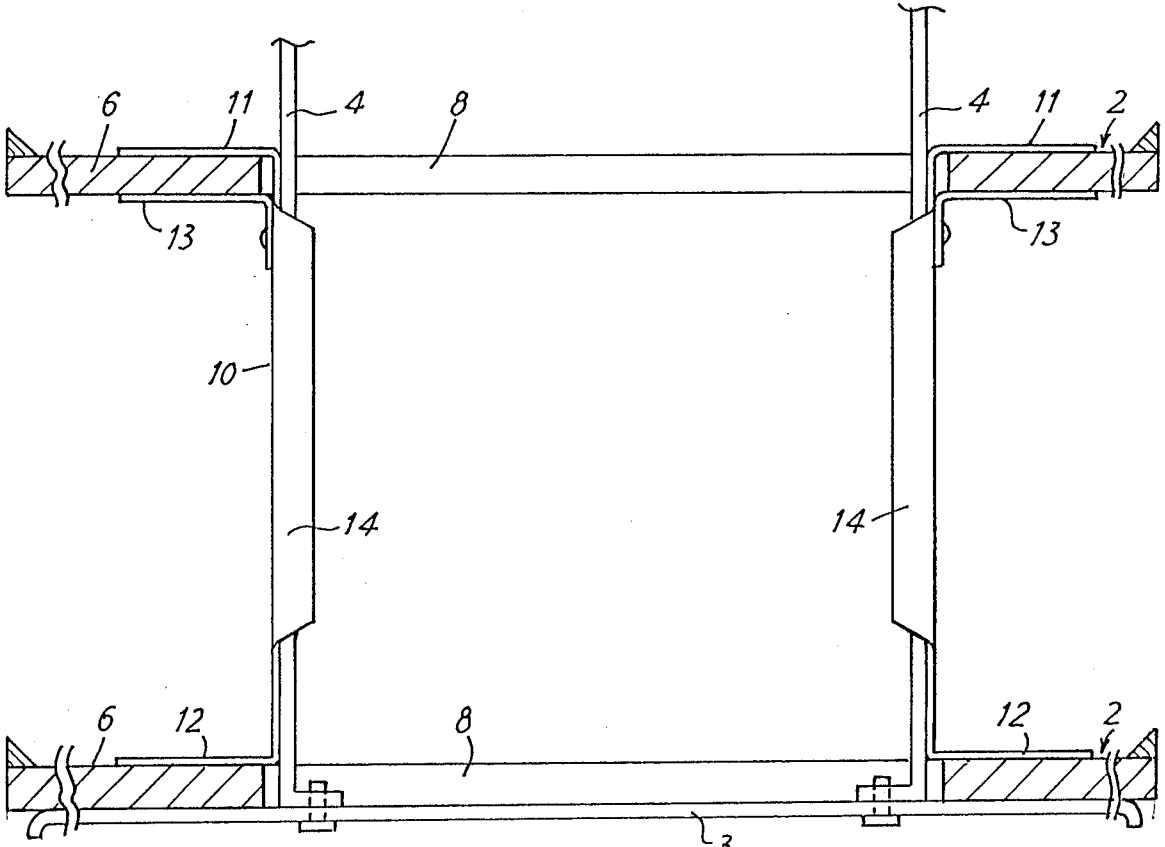
FIG. 5 shows a partial transverse sectional view of two trays and spacers mounted on the base.
Figure 4:
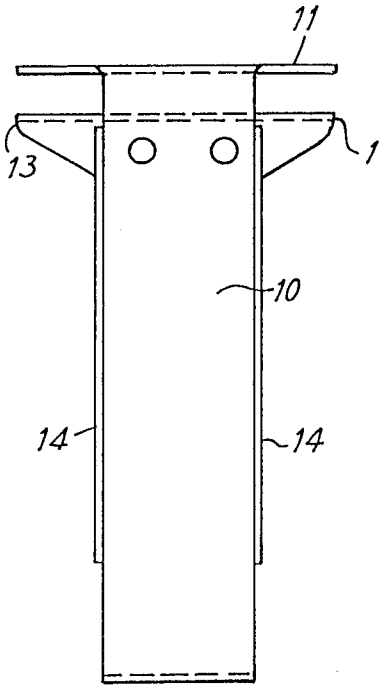
FIG. 4 shows an elevation of a spacer.

FIGS. 4 and 5 illustrate the spacers which engage the trays and the pillars. Each spacer comprises a strut 10 having, at one end, a foot flange 12 at right angles thereto which rests on the lowermost tray of two successive trays. At its upper end, each spacer strut is provided with a pair of spaced-apart right-angled brackets 11, 13 which engage the top and bottom surfaces of the uppermost tray adjacent one end of its slot 8. When installed each spacer lies adjacent one of the pillars 4. Side flanges 14 on the strut lie in abutting relationship with the side edges of a respective pillar to assist stability. Each successive tray above the bottom tray is installed by engaging two spacers one at each end of the tray slot and sliding the tray over the handle so that the spacer struts engage the respective pillars until the spacer flanges 12 meet the lower tray.

In this way the number of trays which can be stacked is limited only by the height of the pillars 4. Since, when the assembly is complete, the carrying handle is located higher than the topmost tray, the centre of gravity of the assembly even when loaded is beneath the handle so that a condition of stable equilibrium results. This is particularly useful if the trays are to be carried by unskilled serving staff or in a moving vehicle.

I claim:

1. A demountable tray assembly comprising:

a plurality of superimposed trays, each tray having a centrally disposed non-circular aperture in the shape of a slot extending transversely part way across the tray; and a base including upstanding supporting means and a carrying handle, said upstanding supporting means terminating in said carrying handle, the supporting means and said carrying handle being shaped and dimensioned to pass through each tray aperture to prevent any substantial movement of the trays other than at right angles to their planes, the trays being placed on the supporting means and removed therefrom over the carrying handle.

2. A demountable tray assembly according to claim 1, wherein the supporting means includes a pair of spaced-apart pillars fixedly interconnected at one end by the carrying handle.

3. A demountable tray assembly according to claim 1, further comprising a plurality of spacers for insertion substantially vertically between adjacent trays stacked on the supporting means, each spacer being in the form of a strut having a flange at one end extending at right angles thereto for resting on one of the base and a tray stacked on the base, a pair of right-angled brackets being located at the other end of said spacer, said brackets being spaced apart at a distance equal to the thickness of a tray for engaging top and bottom surfaces of the tray located immediately above said one of the stacked trays adjacent one end of its slot shaped aperture, and side flanges forming a channel with the strut to accommodate the supporting means and prevent sideways movement of the spacer.

4. A demountable tray assembly according to claim 1, wherein said trays are substantially rectangular shaped.

* * * * *